US009578430B2

(12) United States Patent
Nielsen et al.

(10) Patent No.: US 9,578,430 B2
(45) Date of Patent: Feb. 21, 2017

(54) HEARING AID

(71) Applicant: GN ReSound A/S, Ballerup (DK)

(72) Inventors: Henrik Nielsen, Roskilde (DK); Jan Johansen, Koge (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 14/331,918

(22) Filed: Jul. 15, 2014

(65) Prior Publication Data

US 2015/0296313 A1 Oct. 15, 2015

(30) Foreign Application Priority Data

Apr. 10, 2014 (DK) ..... 2014 70202
Apr. 10, 2014 (EP) ..... 14164147

(51) Int. Cl.
*H04R 25/00* (2006.01)
*H04R 25/02* (2006.01)

(52) U.S. Cl.
CPC ..... *H04R 25/654* (2013.01); *H04R 25/604* (2013.01); *H04R 25/02* (2013.01); *H04R 2225/025* (2013.01)

(58) Field of Classification Search
CPC ..... H04R 25/60; H04R 25/65; H04R 25/602; H04R 2225/31; H04R 2225/33; H04R 2460/17; H04R 2225/023; H04R 2225/025
USPC ..... 381/322–325, 328
See application file for complete search history.

(56) References Cited

U.S. PATENT DOCUMENTS 2,950,357 A * 8/1960 Mitchell ..... H04R 25/554 381/328
2,959,645 A * 11/1960 Ladd ..... H04R 25/652 381/328
3,408,461 A * 10/1968 Langford ..... H04R 25/48 381/322
3,852,540 A 12/1974 Diethelm
4,553,627 A 11/1985 Gastmeier et al.
4,679,650 A 7/1987 Moser et al.
4,937,876 A 6/1990 Biermans
(Continued)

FOREIGN PATENT DOCUMENTS

DE 3428166 A1 2/1986
DE 10 2008 055 919 A1 3/2009
(Continued)

OTHER PUBLICATIONS

An extended European Search Report dated Sep. 18, 2014, issued in the European Patent Application No. 14164146.4-1901, Applicant: GN ReSound A/S, Reference No. P1750EP00 (6pages).
(Continued)

*Primary Examiner* — Suhan Ni
(74) *Attorney, Agent, or Firm* — Vista IP Law Group, LLP

(57) ABSTRACT

A hearing aid includes: a receiver having a side face with a sound outlet, and wherein a primary direction of the sound outlet is perpendicular to the side face; a hearing aid housing having an outer surface and an internal cavity configured for containing the receiver; a filter socket coupled to the hearing aid housing; and a filter releasably attached to the filter socket; wherein the filter socket defines a direction of detachment of the filter from the filter socket, and wherein the direction of detachment is arranged obliquely with respect to the primary direction of the sound outlet.

14 Claims, 2 Drawing Sheets

(56) References Cited

U.S. PATENT DOCUMENTS

| | | | | |
|---|---|---|---|---|
| 4,972,488 | A | 11/1990 | Weiss | |
| 5,099,947 | A | 3/1992 | Guggenberger et al. | |
| 5,278,360 | A | 1/1994 | Carbe | |
| 5,970,157 | A | 10/1999 | Yoest | |
| 6,129,174 | A | 10/2000 | Brown et al. | |
| 6,205,227 | B1 | 3/2001 | Mahoney et al. | |
| 6,389,143 | B1 | 5/2002 | Leedom et al. | |
| 6,434,248 | B1 | 8/2002 | Juneau et al. | |
| 6,865,279 | B2 * | 3/2005 | Leedom | H04R 25/608 381/322 |
| 7,991,179 | B2 * | 8/2011 | Drambarean | H04R 1/1016 381/325 |
| 8,098,866 | B2 | 1/2012 | Gommel et al. | |
| 2001/0043708 | A1 | 11/2001 | Brimhall | |
| 2002/0027996 | A1 | 3/2002 | Leedom et al. | |
| 2002/0198437 | A1 | 12/2002 | Juneau et al. | |
| 2003/0198361 | A1 | 10/2003 | Heerlein et al. | |
| 2006/0153418 | A1 | 7/2006 | Van Halteren | |
| 2009/0041261 | A1 | 2/2009 | Fickweiler et al. | |
| 2009/0046880 | A1 | 2/2009 | Gunnersen et al. | |
| 2010/0220884 | A1 | 9/2010 | Aquilina et al. | |
| 2011/0013797 | A1 | 1/2011 | Cheng et al. | |
| 2012/0163643 | A1 | 6/2012 | Vestergaard et al. | |

FOREIGN PATENT DOCUMENTS

| | | | |
|---|---|---|---|
| DE | 10 2010 041 695 | A1 | 8/2011 |
| EP | 0 312 517 | A2 | 4/1989 |
| EP | 2 663 097 | A1 | 11/2013 |
| EP | 2 750 413 | A1 | 7/2014 |
| WO | WO 01/43498 | A1 | 6/2001 |
| WO | WO 2010147554 | A1 | 12/2010 |
| WO | WO 2012006383 | A1 | 1/2012 |
| WO | WO 2013091682 | A1 | 6/2013 |

OTHER PUBLICATIONS

An Office Communication dated Oct. 30, 2014, issued in the Danish Patent Application No. PA 2014 70201, Applicant: GN ReSound A/S, Reference No. P1750DK00 (7pages).

An Office Communication dated Oct. 21, 2014, issued in the Danish Patent Application No. PA 2014 70199, Applicant: GN ReSound A/S, Reference No. P1596DK00 (6pages).

An Office Communication dated Oct. 24, 2014, issued in the Danish Patent Application No. PA 2014 70200, Applicant: GN ReSound A/S, Reference No. P1597DK00 (6pages).

An Office Communication dated Oct. 31, 2014, issued in the Danish Patent Application No. PA 2014 70202, Applicant: GN ReSound A/S, Reference No. P1751DK00 (7pages).

Second Technical Examination dated May 19, 2015, for related Danish Patent Application No. PA 2014 70199, 3 pages.

Second Technical Examination dated May 20, 2015, for related Danish Patent Application No. PA 2014 70200, 3 pages.

Non-final Office Action dated Aug. 26, 2015 for related U.S. Appl. No. 14/336,471.

Non-final Office Action dated Aug. 26, 2015 for related U.S. Appl. No. 14/336,863.

Non-final Office Action dated Oct. 5, 2015 for rleated U.S. Appl. No. 14/333,397.

Notice of Allowance and Fee(s) Due dated Mar. 2, 2016 for related U.S. Appl. No. 14/336,471.

Notice of Allowance and Fee(s) Due dated Mar. 9, 2016 for related U.S. Appl. No. 14/336,863.

Notice of Allowance and Fee(s) Due dated Mar. 28, 2016 for related U.S. Appl. No. 14/333,397.

Second Technical Examination dated Sep. 16, 2015 for related Danish Patent Application No. PA 2014 70201.

Second Technical Examination dated Sep. 21, 2015 for related Danish Patent Application No. PA 2014 70202.

Communication pursuant to Article 94(3) EPC dated Jul. 6, 2016 for related EP Patent Application No. 14 164 146.4, 4 pages.

Communication pursuant to Article 94(3) EPC dated Jul. 7, 2016 for corresponding EP Patent Application No. 14 164 145.6, 7 pages.

Communication pursuant to Article 94(3) EPC dated Jul. 7, 2016 for related EP Patent Application No. 14 164 143.1, 7 pages.

Non-final Office Action dated Aug. 12, 2016 for related U.S. Appl. No. 14/333,397.

* cited by examiner

HEARING AID

RELATED APPLICATION DATA

This application claims priority to, and the benefit of, Danish Patent Application No. PA 2014 70202, filed on Apr. 10, 2014, pending, and European Patent Application No. 14164147.2, filed on Apr. 10, 2014, pending. The entire disclosures of the above applications are expressly incorporated by reference herein.

FIELD

The present disclosure relates to a hearing aid comprising a housing with a receiver/loudspeaker having a substantially plane side face with a sound outlet opening, and where the hearing aid further comprises a filter, e.g. a cerumen filter, and the housing comprises an outer surface and an internal cavity adapted for containing the receiver/loudspeaker, and a filter socket arranged in the outer surface, and wherein the filter is releasably attached, and where a sound channel is arranged between the receiver and the filter socket and being adapted for directing sound from the receiver/loudspeaker to the filter socket, and where the filter socket defines a direction of detachment of the filter from the filter socket, and the receiver/loudspeaker defines a primary direction of sound outlet being perpendicular to the substantially plane side face of the receiver.

BACKGROUND

Hearing aids of the above mentioned kind are known in a lot of different embodiments, where the filter is mostly used as a wax guard with the primary purpose of avoiding ear wax from migrating into the receiver.

Especially in relation to ITE "In The Ear" hearing aids there is an ongoing research and development with respect to provide ITE hearing aids with optimal sound quality and performance.

SUMMARY

A hearing aid is provided, where especially the receiver and the filter socket is optimally arranged with respect to provide a good sound quality on the one hand, and a reduced volume required for the components, especially the filter socket and the receiver.

This is obtained by a hearing aid as mentioned in the introduction, and by arranging the receiver and the filter socket so that the direction of detachment is arranged obliquely with respect to the primary direction of sound outlet. Thereby the hearing aid can be designed so that the filter socket is placed very deep in the ear channel, and thereby also the receiver can be moved to a position in the hearing aid further into the ear when the ITE hearing aid is positioned in the ear.

In a preferred embodiment the sound channel and the receiver/loudspeaker are relatively sized in order to allow for insertion of the receiver/loudspeaker through the filter socket and the sound channel and into the internal cavity, when the filter is detached from the filter socket. This provides the option of servicing/exchanging the receiver by pulling it out of the hearing aid through the filter socket, so that it is not necessary to remove the face plate and other components from the hearing aid when accessing the receiver.

In this relation the filter may preferably comprise a filter holder, and a filter unit, and where the filter holder and the filter unit are adapted for releasably mounting of the filter unit in the filter holder, and the filter holder is attached in the filter socket.

Furthermore the receiver/loudspeaker may advantageously comprise a receiver housing having a first substantially plane side face with a sound opening, and the filter holder comprises a substantially plane bottom plate (bottom side), and where the filter holder is fastened to the receiver housing, so that the substantially plane bottom plate of the filter holder abuts the substantially plane side face of the receiver housing, and so that the sound opening is aligned with the first opening.

In a further preferred embodiment, the substantially plane bottom plate is fastened to the first substantially plane side face of the receiver housing.

The receiver and filter are easily removed as a unit by permanently fastening the filter holder to the receiver housing by gluing, soldering or welding and by arranging the filter holder releasably attached to the housing with a press fit, a frictional fit, or by means of heat releasable glue.

In a preferred embodiment, the hearing aid further comprises a signal processor arranged in the internal cavity of the housing, and being adapted for providing an audio signal to the receiver/loudspeaker via a set of electrical wires extending from the signal processor and to the receiver, and where the length of the electrical wires are so long that the receiver can be pulled out of the internal cavity through the filter socket, without the need of dismantling or stretching the electrical wires.

The angle between the direction of detachment and the primary direction of sound is within the range from 5° to 45° and preferably in the range from 10° to 30° being most suitable for ITE hearing aids due to the complex geometry of the ear channel.

A hearing aid includes: a receiver having a side face with a sound outlet, and wherein a primary direction of the sound outlet is perpendicular to the side face; a hearing aid housing having an outer surface and an internal cavity configured for containing the receiver; a filter socket coupled to the hearing aid housing; and a filter releasably attached to the filter socket; wherein the filter socket defines a direction of detachment of the filter from the filter socket, and wherein the direction of detachment is arranged obliquely with respect to the primary direction of the sound outlet.

Optionally, the hearing aid further includes a sound channel located between the receiver and the filter socket, or located in the filter socket, the sound channel configured for directing sound from the receiver.

Optionally, the filter socket is sized for insertion of the receiver therethrough into the internal cavity when the filter is detached from the filter socket.

Optionally, the receiver comprises a receiver housing having the side face and the sound outlet.

Optionally, the filter socket comprises a bottom side that abuts the side face of the receiver.

Optionally, the bottom side of the filter socket is fastened to the side face of the receiver.

Optionally, the filter socket is permanently fastened to the receiver.

Optionally, the filter socket is permanently fastened to the receiver by gluing, soldering or welding.

Optionally, the filter socket is releasably attached to the receiver.

Optionally, the filter socket is releasably attached to the receiver with a press fit, a frictional fit, a snap connection, or a heat releasable glue.

Optionally, the hearing aid further includes a signal processor arranged in the internal cavity of the hearing aid housing, wherein the signal processor is configured for providing an audio signal to the receiver via a set of electrical wires extending from the signal processor to the receiver.

Optionally, a length of at least one of the electrical wires permits pulling the receiver out of the internal cavity of the hearing aid housing through the filter socket, the length being long enough to allow access to mounting points of the electrical wires without a need of dismantling, cutting or stretching the electrical wires.

Optionally, an angle between the direction of detachment and the primary direction of the sound outlet is anywhere from 5° to 45°.

Other and further aspects and features will be evident from reading the following detailed description of the embodiments.

BRIEF DESCRIPTION OF THE DRAWINGS

In the following, the embodiments will be described in greater detail with reference to the figures. It should be emphasized that the embodiments shown are used for example purposes only and should not be used to limit the scope of the claimed invention.

DETAILED DESCRIPTION OF THE EMBODIMENTS

It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Figure 1:
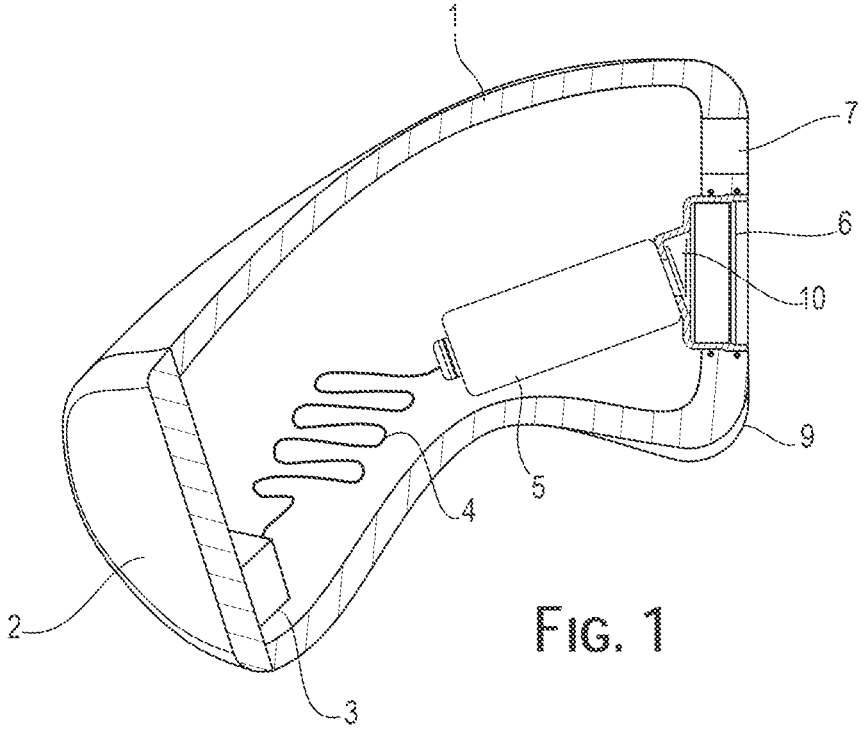
FIG. 1: Is a principle drawing showing a cross section of a hearing aid according to some embodiments.
Figure 4:
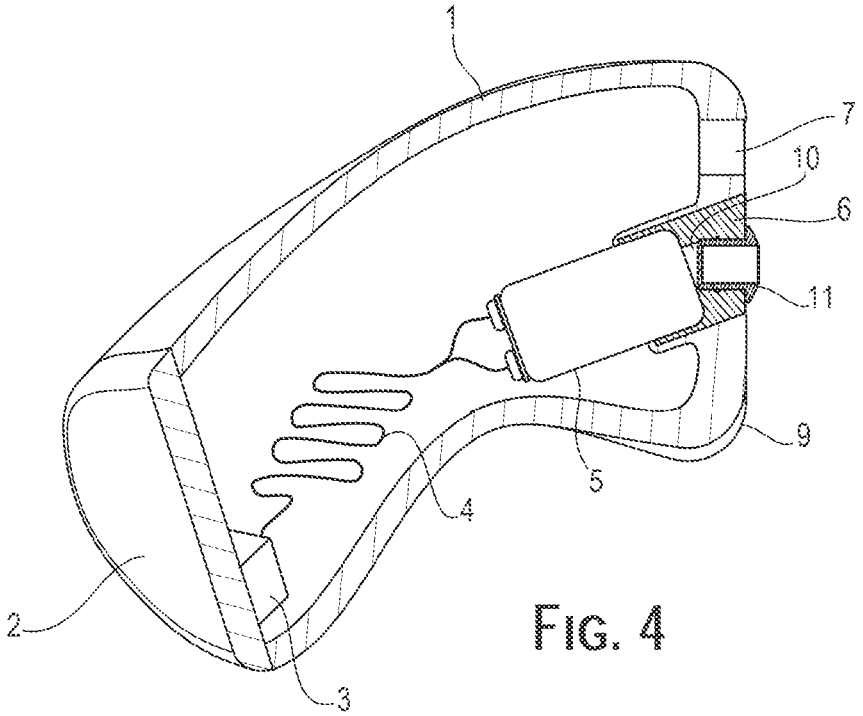
FIG. 4: Is a principle drawing showing a cross section of another embodiment of a hearing aid according to some embodiments.

FIGS. 1 and 4 Are principle drawings showing a cross section through hearing aid according to different embodiments. These hearing aids are both of the ITE (in the ear) type being adapted for being positioned completely in the ear of the user, but it will be apparent to the skilled person that the features described herein will also be applicable to other types of hearing aids being only partly positioned in the ear of the user.

The hearing aids shown in FIGS. 1 and 4 has a hearing aid housing 1 being closed at one end by a face plate 2, which will normally be the only visible part of the hearing aid, when the hearing aid is positioned in the ear of a user. Thereby the hearing aid housing 1 and the face plate 2 encloses an internal cavity 8.

In hearing aids of the ITE type all functional devices, such as electronics 3, batteries (not shown), wiring 4, a microphone (not shown), a receiver 5 and a cerumen filter socket 6 necessary for the function of the hearing aid have to be positioned in the narrow space provided by the internal cavity 8 in the hearing aid housing 1, and therefore it is important to have a high degree of freedom with respect to positioning each device in an optimal position in order to optimally utilize the space in the hearing aid housing 1.

As it is apparent to the skilled person what functional devices are necessary or nice to have in an ITE hearing aid, then only the electronics 3, the wiring 4, the cerumen filter socket 6 and the receiver 5 is shown in FIGS. 1 and 4.

Normally the hearing aid housing 1 further comprises e.g. a pressure equalizing channel 7 extending from the internal cavity 8 and to the outer surface on the hearing aid housing 1. This pressure equalizing channel 7 must be arranged so that it is possible, e.g. via a tube extending from the pressure equalizing channel 7 and to a corresponding opening in the face plate 2 (not shown), to equalize pressure differences between the environment and the closed space in the ear of the user carrying the hearing aid, and thereby further reducing the freedom to position the functional devices in the internal cavity 8 of the hearing aid housing 1.

In the hearing aid hosing 1 a cerumen filter socket 6 is arranged in the end of the hearing aid housing facing the inside of the ear of the user, and a sound channel 10 extending between the filter socket 6 and the receiver 5.

Figure 2:
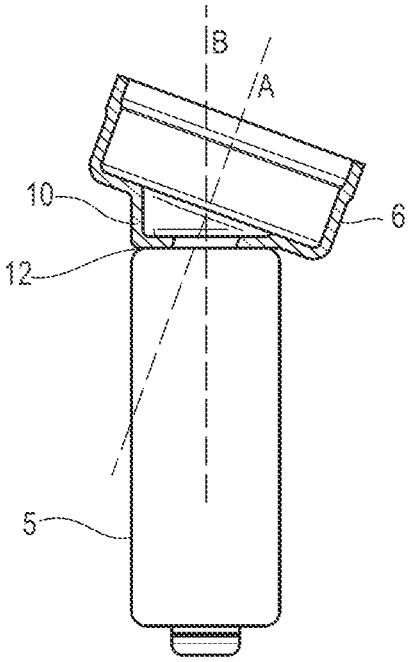
FIG. 2: Shows the filter/receiver assembly shown in FIG. 1.
Figure 3:
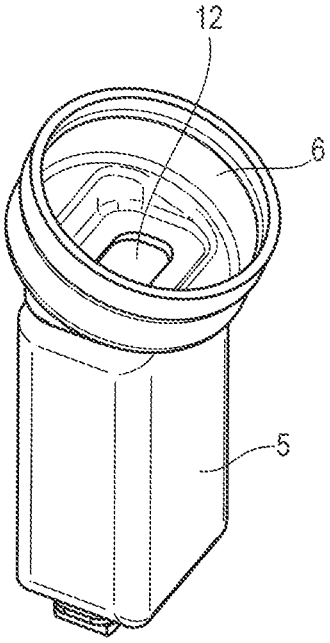
FIG. 3: Is a perspective view of the assembled filter and receiver shown in FIGS. 1 and 2.

The filter socket 6 shown in FIGS. 1, 2 and 3 is made from by deep drawing a sheet of metal to the shape shown in the figures, and is thereafter fixed to the side face 12 (which may be a planar side face) of the receiver 5 by welding or soldering. In the embodiment shown in FIGS. 4, 5 and 6 the filter socket 6 is as an alternative made from a plastic material, e.g. by injection moulding, and the filter socket 6 is thereafter mounted on the receiver 5 by means of a friction fit, a snap fit or by gluing.

Figure 5:
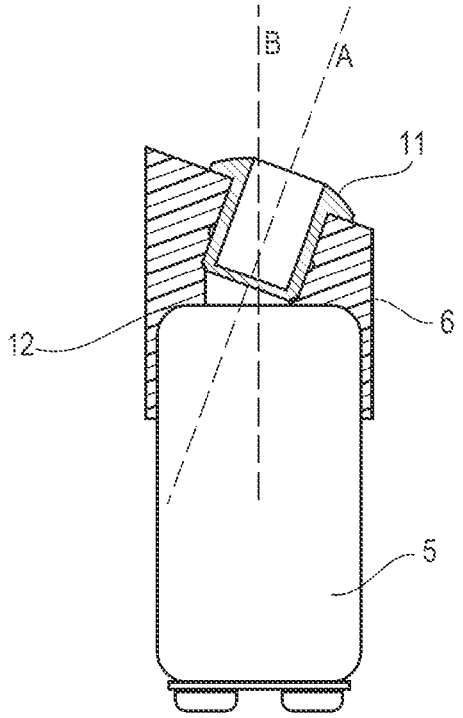
FIG. 5: Shows the filter/receiver assembly shown in FIG. 4.
Figure 6:
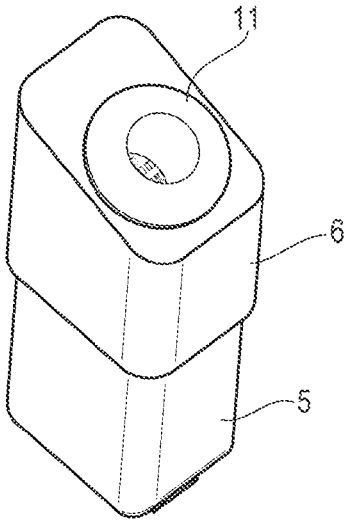
FIG. 6 Is a perspective view of the filter/receiver assembly shown in FIGS. 4 and 5.

According to the shown embodiments, the filter socket 6 is adapted for insertion and detachment of a filter unit 11, such as a cerumen filter, and so that the filter unit 11 can be inserted or detached in a direction of detachment as shown by the dotted line A in FIGS. 2 and 5, and the receiver 5 has a plane side face 12 with a sound exit opening defining a primary direction of the sound outlet from the receiver 5 being perpendicular to the plane side face 12 as shown by the dotted line B in FIGS. 2 and 5.

In order to provide the best options for positioning the filter/receiver assembly in the hearing aid housing 1, so that the receiver 5 requires as little space as possible in the internal cavity 8, then the filter socket 6, the sound channel 10, and the receiver 5 are designed so that the direction of detachment A is arranged obliquely to the primary direction of the sound outlet B.

Although some embodiments have been described and shown in detail, the claimed invention is not restricted to them, but may also be embodied in other ways within the scope of the subject matter defined in the following claims. In particular, it is to be understood that other embodiments may be utilized and structural and functional modifications may be made without departing from the scope of the claimed invention. As an example of this it will be apparent to the skilled person that the features described herein may also be used in relation to hearing aids of another type than the above mentioned ITE type, even though the advantages described herein are especially relevant to the ITE type hearing aids.

In device claims enumerating several features, several of these features can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The following items are in accordance with one or more embodiments described herein:

Item 1. A hearing aid comprising a hearing aid housing with a receiver having a substantially plane side face with a sound outlet opening, and where the hearing aid further comprises a filter, e.g. a cerumen filter, the hearing aid housing comprising an outer surface and an internal cavity adapted for containing the receiver and a filter socket arranged in the outer surface, the filter being releasably attached to the filter socket, wherein a sound channel is arranged between the receiver and the filter socket and being adapted for directing sound from the receiver to the filter socket, the filter socket defining a direction of detachment of the filter from the filter socket and the receiver defining a primary direction of a sound outlet being perpendicular to the substantially plane side face and the direction of detachment is arranged obliquely with respect to the primary direction of the sound outlet.

Item 2. A hearing aid according to item 1, wherein the filter socket, the sound channel and the receiver are relatively sized in order to allow for insertion of the receiver through the filter socket and the sound channel into the internal cavity when the filter is detached from the filter socket.

Item 3. A hearing aid according to item 1 or 2, wherein the filter comprises a filter holder and a filter unit, and wherein the filter holder and the filter unit are adapted for releasably mounting the filter unit in the filter holder and the filter holder is attached in the filter socket.

Item 4. A hearing aid according to item 1, 2 or 3, where the receiver comprises a receiver housing having a first substantially plane side face with a sound opening, the filter holder comprising a substantially plane bottom plate, wherein the filter holder is fastened to the receiver housing, in such a way that the substantially plane bottom plate of the filter holder abuts the substantially plane side face of the receiver housing and the sound opening is aligned with the first opening.

Item 5. A hearing aid according to item 4, where the substantially plane bottom plate is fastened to the first substantially plane side face of the receiver housing.

Item 6. A hearing aid according to item 4 or 5, where the filter holder is permanently fastened to the receiver housing by gluing, soldering or welding.

Item 7. A hearing aid according to item 4, 5 or 6, where the filter holder is releasably attached to the housing with a press fit, a frictional fit, a snap connection or by means of heat releasable glue.

Item 8. A hearing aid according to item 1, the hearing aid comprising a signal processor arranged in the internal cavity of the housing, and being adapted for providing an audio signal to the receiver via a set of electrical wires extending from the signal processor and to the receiver, wherein the length of the electrical wires permits pulling the receiver out of the internal cavity through the filter socket, the length being long enough to allow access to the mounting points of the electrical wires without the need of dismantling cutting or stretching the electrical wires.

Item 9. A hearing aid according to one or more of the preceding items, wherein the angle between the direction of detachment and the primary direction of sound is within the range from 5° to 45° and preferably in the range from 10° to 30°.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents, as defined by the claims.

The invention claimed is:

1. A hearing aid comprising:

a receiver having a side face with a sound outlet, and wherein a primary direction of the sound outlet is perpendicular to the side face;

a hearing aid housing having an outer surface and an internal cavity configured for containing the receiver, wherein the hearing aid housing has a housing opening at the outer surface; and a filter configured to releasably attach to the hearing aid housing at the housing opening, and wherein the filter is configured to engage with the receiver;

wherein the housing opening defines a direction of detachment of the filter from the housing opening, and wherein the direction of detachment is arranged obliquely with respect to the primary direction of the sound outlet.

2. The hearing aid according to claim 1, further comprising a sound channel located between the receiver and the housing opening, the sound channel configured for directing sound from the receiver.

3. The hearing aid according to claim 2, wherein the housing opening is sized for insertion of the receiver therethrough into the internal cavity.

4. The hearing aid according to claim 1, wherein the receiver comprises a receiver housing having the side face and the sound outlet.

5. The hearing aid according to claim 1, wherein the filter comprises a filter holder and a filter unit, the filter folder configured to hold the filter unit.

6. The hearing aid according to claim 5, wherein the filter holder comprises a bottom side that abuts the side face of the receiver.

7. The hearing aid according to claim 5, wherein the filter holder is permanently fastened to the receiver.

8. The hearing aid according to claim 7, wherein the filter holder is permanently fastened to the receiver by gluing, soldering or welding.

9. The hearing aid according to claim 5, wherein the filter holder is releasably attached to the hearing aid housing.

10. The hearing aid according to claim 9, wherein the filter holder is releasably attached to the hearing aid housing with a press fit, a frictional fit, a snap connection, or a heat releasable glue.

11. The hearing aid according to claim 1, further comprising a signal processor arranged in the internal cavity of the hearing aid housing, wherein the signal processor is configured for providing an audio signal to the receiver via a set of electrical wires extending from the signal processor to the receiver.

12. The hearing aid according to claim 1, wherein an angle between the direction of detachment and the primary direction of the sound outlet is anywhere from 5° to 45°.

13. A hearing aid comprising:

a receiver having a side face with a sound outlet, and wherein a primary direction of the sound outlet is perpendicular to the side face;

a hearing aid housing having an outer surface and an internal cavity configured for containing the receiver, wherein the hearing aid housing has a housing opening at the outer surface; and a filter configured to releasably attach to the hearing aid housing at the housing opening;

wherein the housing opening defines a direction of detachment of the filter from the housing opening, and wherein the direction of detachment is arranged obliquely with respect to the primary direction of the sound outlet;

wherein the filter comprises a filter holder and a filter unit, the filter folder configured to hold the filter unit;

wherein the filter holder comprises a bottom side that abuts the side face of the receiver; and wherein the bottom side of the filter holder is fastened to the side face of the receiver.

14. A hearing aid comprising:

a receiver having a side face with a sound outlet, and wherein a primary direction of the sound outlet is perpendicular to the side face;

a hearing aid housing having an outer surface and an internal cavity configured for containing the receiver, wherein the hearing aid housing has a housing opening at the outer surface; and a filter configured to releasably attach to the hearing aid housing at the housing opening; and a signal processor arranged in the internal cavity of the hearing aid housing, wherein the signal processor is configured for providing an audio signal to the receiver via a set of electrical wires extending from the signal processor to the receiver;

wherein the housing opening defines a direction of detachment of the filter from the housing opening, and wherein the direction of detachment is arranged obliquely with respect to the primary direction of the sound outlet;

wherein a length of at least one of the electrical wires permits pulling the receiver out of the internal cavity of the hearing aid housing through the housing opening, the length being long enough to allow access to mounting points of the electrical wires without a need of dismantling, cutting or stretching the electrical wires.

* * * * *